US005247770A

United States Patent [19]

Ting

[11] Patent Number: 5,247,770

[45] Date of Patent: Sep. 28, 1993

[54] EXTERIOR COMPOSITE FOAM PANEL WALL JOINT DESIGN

[76] Inventor: Raymond M. L. Ting, 318 Holiday Dr., Pittsburgh, Pa. 15237

[21] Appl. No.: 820,148

[22] Filed: Jan. 13, 1992

[51] Int. Cl.[5] ..... E04C 1/10

[52] U.S. Cl. ..... 52/309.9; 52/309.11; 52/580; 52/588

[58] Field of Search ..... 52/281, 282.3, 309.9, 52/309.11, 468, 593, 595, 584, 586, 741.4, 580, 588, 512

[56] References Cited

U.S. PATENT DOCUMENTS

| | | | |
|---|---|---|---|
| 3,397,496 | 8/1968 | Sohns | 52/580 |
| 3,760,548 | 9/1973 | Sauer et al. | 52/309.11 |
| 3,777,430 | 12/1973 | Tischuk | 52/309.9 |
| 4,236,366 | 12/1980 | Rijnders | 52/580 |
| 4,316,351 | 2/1982 | Ting | 52/309.9 |
| 4,998,396 | 3/1991 | Palmersten | 52/580 |
| 5,086,599 | 2/1992 | Meyerson | 52/741.4 |
| 5,092,095 | 3/1992 | Zadok et al. | 52/309.9 |

*Primary Examiner*—Carl D. Friedman
*Assistant Examiner*—Winnie Yip
*Attorney, Agent, or Firm*—William J. Ruano

[57] ABSTRACT

This invention relates to the wall joint design using composite wall panels each consisting of two metal facing skins sandwiched with a structural foam core. The sealing, stuructural performance, and fire performance of the panel sidejoint are significantly improved without compromising other functional performances. The vertical wall joint in horizontal panel application is improved with respect to sealing integrity, thermal insulating value, and easiness in construction.

3 Claims, 3 Drawing Sheets

EXTERIOR COMPOSITE FOAM PANEL WALL JOINT DESIGN

BACKGROUND OF THE INVENTION

1. Field of the Invention

This invention relates to exterior building wall structures and, more particularly, to composite foam panels with concealed fastening systems. The composite foam panel consists of a structural foam core sandwiched between two metal skins. The metal skins are commonly painted carbon steel, aluminum, or stainless steel of thicknesses ranging from 0.018" (0.46 mm) to 0.048" (1.22 mm). The skins act compositely to resist lateral wind loads by way of shear transfer through the structural foam core. The core is structurally connected to the metal skins by chemical or adhesive bond. The depth of the panel normally ranges from 1 inch (25 mm) to 8 inches (203 mm), depending on load or thermal insulation requirements. The coverwidth of the panel normally ranges from 12 inches (305 mm) to 48 inches (1219 mm). The length of the panel is normally limited to a maximum of 45 feet (13.7 m) due to production, shipping, or field handling limitations. The exterior and the interior metal skins are profiled into separate compatible pairs of male and female side joints. Each panel consists of a fastened side edge and an engaged side edge. Fasteners are used to secure the panel to the building frame along the fastened side edge. The engaged side edge is to cause structural interlocking with the fastened side edge of the adjacent panel, to form a sealed side joint, and to conceal the side joint fasteners of the adjacent panel. In this manner, a number of panel side joints are formed on the finished wall surface without exposing any fastener. Due to the panel length limitation, panel butt joints are formed in most buildings. When the panel side joints are oriented vertically with the panel butt joints running horizontally, the construction is known as vertical panel application. When the panel side joints are oriented horizontally with the panel butt joints running vertically, the construction is known as horizontal panel application.

2. Description of the Prior Art

Composite foam panels have been widely used in exterior wall construction. In designing an exterior wall using composite foam panels, the following four functions must be considered: (1) structural performance against wind loads; (2) thermal insulating performance; (3) weather sealing performance against air and water infiltrations; and (4) fire performance against fire hazards including flame spread and smoke development.

To provide maximum structural strength, it is desirable to have structural interlocking side joints on both the exterior and the interior metal skins. To provide efficient thermal insulating value, it is desirable to minimize the cavities of the wall joints and the panel profile is designed such that the exterior skin is arranged to have no contact with the interior skin to prevent through thermal conductivity. To provide weather sealing, sealing means or means of controlling the running water are provided within the wall joints. In dealing with fire hazard, all building codes specify the maximum limits on two factors known as flame spread and skome development. Recognizing the fact that the metal skins are incombustible while the foam core is combustible, it is easy to understand that limiting the foam core exposure to the air is the key to improve the fire performance. Improving the fire performance is of prime importance in the market place. In case of fire, there are two sources of oxygen supply to the burning foam core. The first source comes from the air flow within the side joint cavity coming in contact with the foam surface exposed within the side joint cavity. The second source comes from air going around the metal side joint after the sealant in the side joint has been consumed in the fire and usually followed by side joint disengagement due to thermal distortions of the metal skins. In an attempt to improve the fire performance, metal clips or straps intermittently connecting the interior and the exterior metal joints together have been utilized. However, this method increases the cost and the thermal insulating performance is compromised due to the through thermal conductivity of the metal clips or straps.

In the weather sealing function, most of the commercially available foam panels are designed to have a male interior joint and a female exterior joint on the fastening side and the corresponding matching male and female joints on the engaging side. This type of profile is found to be unsuitable for horizontal panel application due to the guttering effect of the exterior joint directing the exterior water toward the vertical butt joint causing water infiltration problem. The first method for solving the problem is to eliminate the exterior interlocking side joint. This solution creates three drawbacks, namely, reduced structural strength against negative wind load, unacceptable fire performance against exterior fire, and the necessity of producing separate products for vertical and horizontal panel applications. The second method for solving the problem is explained in my previous U.S. Pat. No. 4,700,520 in which double male joints on the fastening side and double female joints on the engaging side are utilized. The actions of the pulsatory wind loads and the transverse panel deformations produce pulsatory relative movements between the male and the female joints. These pulsatory relative movements of the side joints create a pumping action on the sealant contained in the side joint, therefore, degradation of the sealing performance over time is a rather common occurrence. In the horizontal panel application, the vertical panel butt joint is normally formed by spacing apart the butting panels by a distance of about ½ inch (12.7 mm) to 1 inch (25.4 mm). Sealant is applied between the interior panel skin and the mullion surface and a joint gasket is provided across the gap between the exterior skins of the butting panels to act as the rain screen. To prevent the unsightly exposure of the foam core to the exterior viewing along the panel ends, integral end caps extending from the exterior skin are fabricated in the shop. Difficulties would occur when panel length adjustment is necessary in the field due to dimensional tolerance of the building frame. Field fabricated panel end cap is much more inferior in quality to the shop fabricated panel end cap. Due to the degradation of the sealing properties caused by negative wind loads, it is common to experience water leakage problem through the vertical joints within few years after erection. To solve the water leakage problem, water drainage control means such as internal gutter system or intermittent water drainage means explained in my previous U.S. Pat. No. 4,765,107 must be utilized. These solutions incurred additional cost and field workmenship control. In addition, the thermal insulating performance is significantly compromised by the panel gap at the vertical joint such that interior water condensation problem along the vertical mullions may be serious in the cold region.

It is clear from the above review of the prior arts that improving one performance parameter must incur additional cost and/or compromise other performance parameters.

SUMMARY OF THE INVENTION

The objectives of this invention is to achieve the following functional improvements simultaneously without compromising each other.

1. To improve the structural performance by increasing the side joint strength against negative wind loads.
2. To ensure long term weather sealing performance of panel side joint by eliminating the relative movements between the male and the female joints after interlocking engagement.
3. To improve fire performance by eliminating foam core exposure within the side joint cavity and limiting the tendency of side joint disengagement due to fire.
4. To improve the thermal insulating performance at the vertical butt joint of horizontal panel application by eliminating the butt joint gap.
5. To provide vertical butt joint design in horizontal panel application for improved weather sealing performance with a joint construction that can be easily implemented or adjusted in the field.

BRIEF DESCRIPTION OF THE INVENTION

DESCRIPTION OF THE PREFERRED EMBODIMENTS

Figure 1:
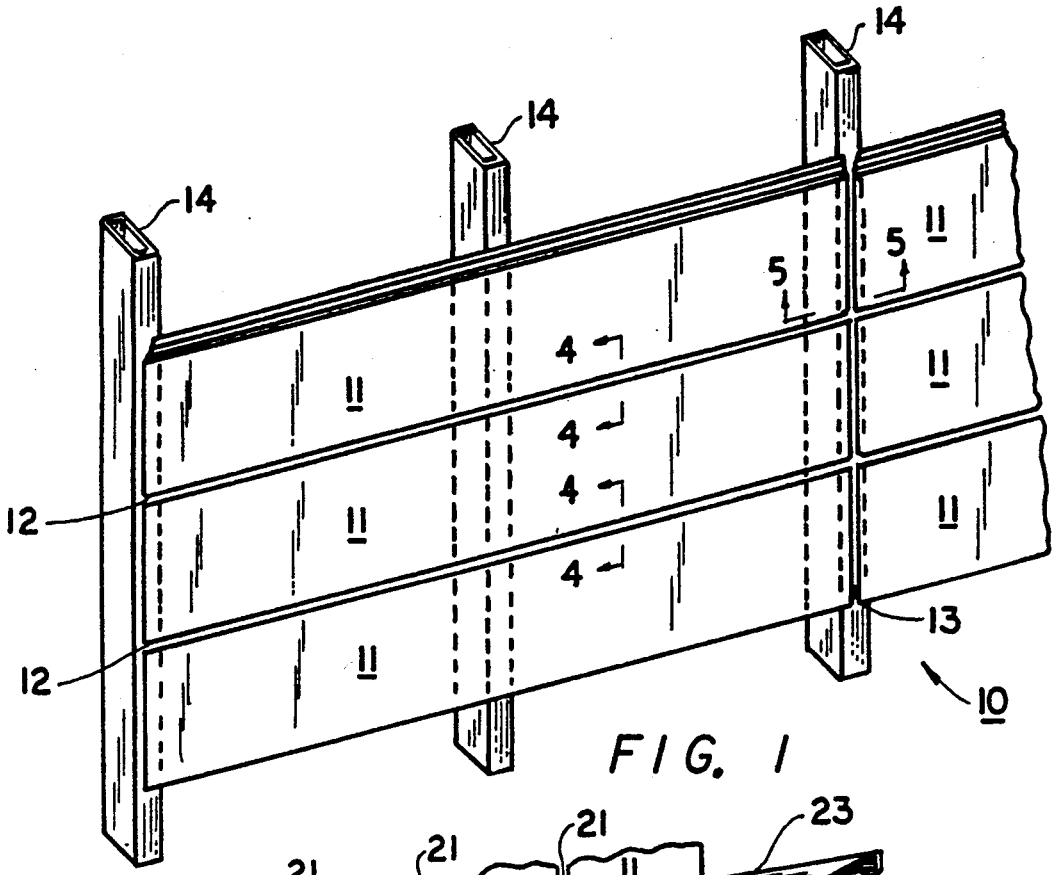
FIG. 1 is an isometric view illustrating a portion of the exterior wall structure in a horizontal panel application.
Figure 3:
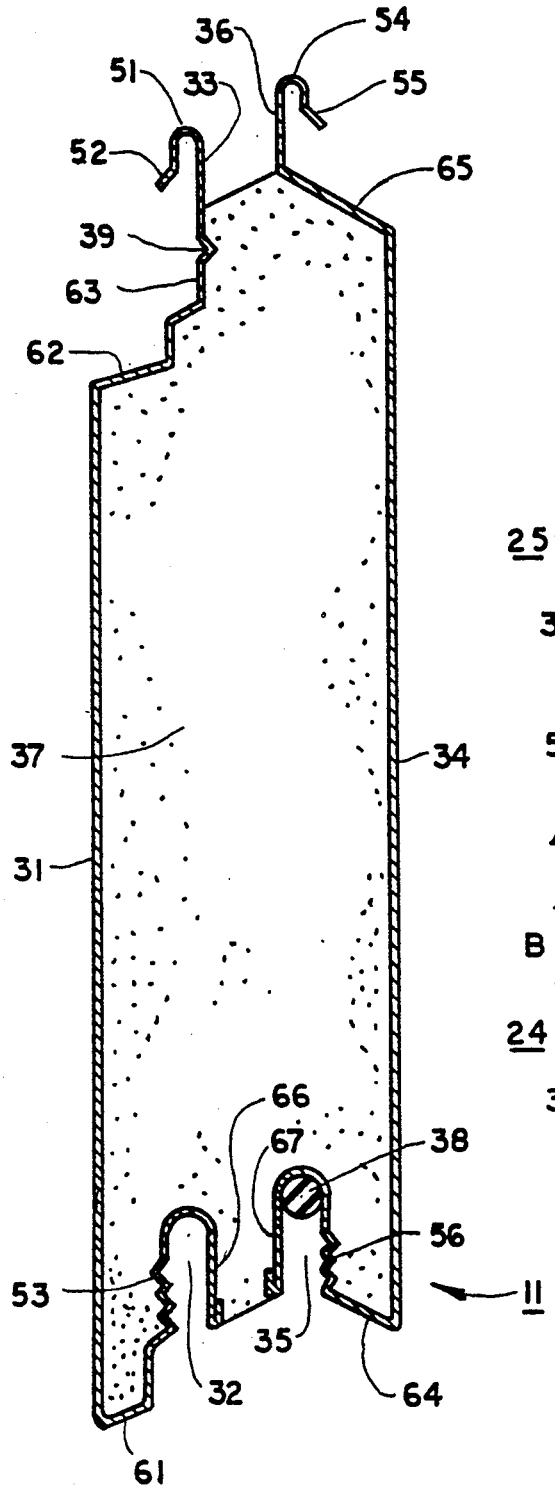
FIG. 3 is a typical cross-sectional view of the composite foam panel of this invention.
Figure 4:
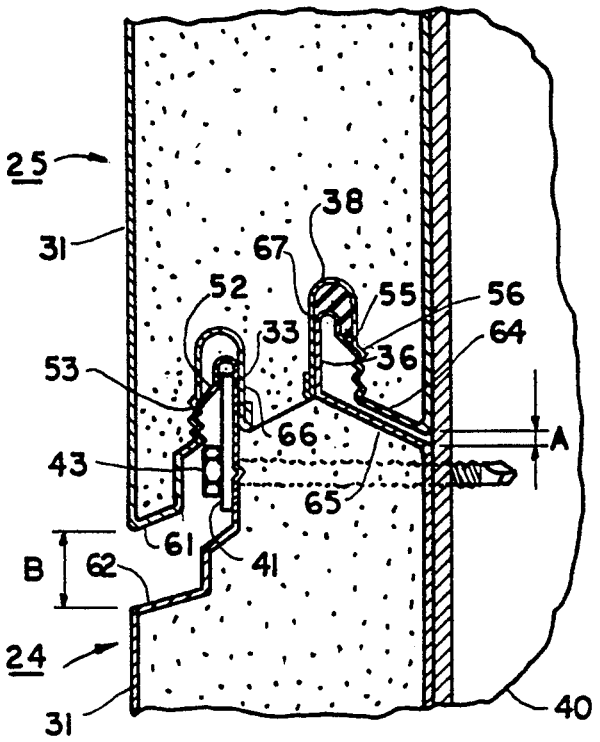
FIG. 4 is a typical cross-sectional view taken along line 4—4 of FIG. 1 or FIG. 2 of the panel side joint of this invention.

FIG. 1 illustrates a wall structure 10 using composite foam panels 11 of this invention in horizontal application. The horizontal joints 12 between panels 11 are formed and sealed by the joinery design of this invention as shown in FIG. 3. The vertical joint 13 between panels 11 is formed by butting the panel ends with the joinery design of this invention as shown in FIG. 4. The panels 11 are securely fastened to horizontally spaced-apart vertical mullions 14 which are part of the building frame.

Figure 2:
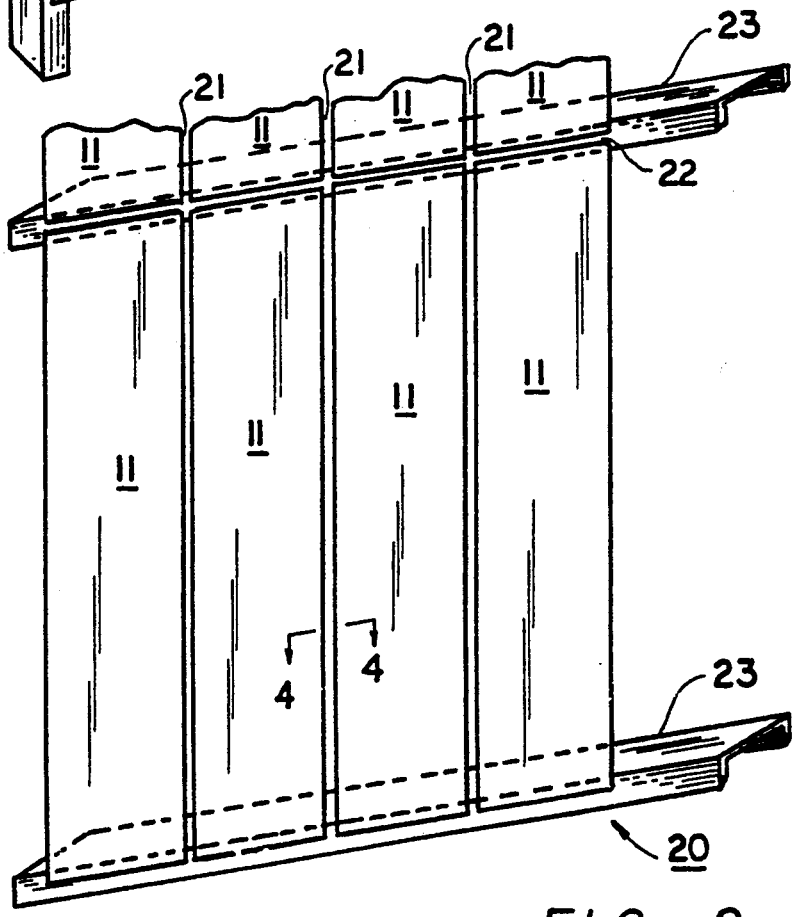
FIG. 2 is an isometric view illustrating a portion of the exterior wall structure in a vertical panel application.

FIG. 2 illustrates a wall structure 20 using composite foam panels 11 of this invention in a vertical panel application. The vertical joint 21 between panels 11 are formed and sealed by the joinery design of this invention as shown in FIG. 3. The horizontal joint 22 between panels 11 can be formed and sealed by various prior art methods. The panels 11 are securely fastened to vertically spaced-apart horizontal girts 23 which are part of the building frame.

FIG. 3 shows a typical cross-section of the composite foam panel 11 of this invention. The panel 11 consists of one exterior metal skin 31, one interior metal skin 34, and a foam core 37 which is structurally adhered to the metal skins 31 and 34 by chemical bond in the case of foamed-in-place manufacturing process and by adhesive bond in the case of laminating manufacturing process. The exterior female joint is formed by forming an extended sloping exterior joint rib 61 followed by at least one mini-corrugation 53 and terminating into a re-entrant joint groove 32 with an inside face 66. The exterior male joint is formed by a sloping exterior shoulder 62 followed by a fastening flange 63 and extended into a male leg 33 followed by a reversely bent element 51 and terminating into an outwardly flared tip 52. It is preferred to provide a fastener guiding groove 39 on the fastening flange 63 so that the fastener can be consistently placed at the design location. The interior female joint is formed by a sloping interior joint rib 64 followed by at least one mini-corrugation 56 and terminating into a re-entrant joint groove 35 with an inside face 67. Shop applied sealant 38 can be disposed inside the joint groove 35. If it is required by special design condition, sealant (not shown) can also be disposed inside the exterior joint groove 32. The interior male joint is formed by a sloping interior shoulder 65 followed by a male leg 36 followed by a reversely bent element 54 and terminating into an outwardly flared tip 55. The profile design indicates that both the exterior and the interior male joints are located on the fastening side and both the exterior and the interior female joints are located on the engaging side.

FIG. 4 shows a typical fragmentary cross-section of the panel side joint taken along line 4—4 of FIG. 1 or FIG. 2 of this invention. The panel 24 (shown as 11 in FIG. 1 and FIG. 2) is fastened into the support 40 (shown as 14 in FIG. 1 and 23 in FIG. 2) on the fastening side using a washer plate 41 and a fastener 43. The engaging side of the next panel 25 (shown as 11 in FIG. 1 and FIG. 2) is then placed into joint engagement with the fastened side of panel 24. After side joint engagement, the other side (not shown) of panel 25 is then fastened into the support 40 and the erection procedures for the next panel are repeated. The side joint design is to allow tight engagements of male tips 52 and 55 into the mini-corrugations 53 and 56 respectively with some resilient spring force retained within the male joints. Multiple mini-corrugations 53 and 56 are desirable due to the consideration of dimensional tolerances during panel production. It can be readily seen that the profiles of the male joints provide flexibility to allow penetration of the male joints into the female joints while at the same time provide mechanical locking resistance against the pulling out actions of the male joints from the female joints. The interior panel joint gap, dimension "A", is preferred to be within $\frac{1}{8}$ inch (3.2 mm) and the exterior panel joint gap, dimension "B", can vary depending on aesthetic requirement. However, a minimum of $\frac{1}{4}$ inch (6.4 mm) in dimension "B" for horizontal panel application should be maintained to allow easy water drainage. In horizontal panel application, panel 24 represents the lower panel while panel 25 represents the upper panel. It can be easily seen from the joint configuration that water infiltration through the panel side joint is impossible due to the water head protection provided by the exterior male joint and the pressure equalized exterior side joint cavity. Under the negative wind load condition, the engaged side (i.e. the side containing female joints) of panel 25 tends to move away from the support 40 and the female joints tend to move laterally away from the male joints due to transverse panel deformation. In addition to the stiffness contribution of the male legs 33 and 36, the tendency of panel moving away from the support 40 is resisted by the wedge action between the interior joint rib 64 and the sloping interior shoulder 65 as well as the composite action between female groove faces 66 and 67. In most commercial panels, the tendency of panel moving away from the support is solely resisted by the stiffness of the male legs. The tendency of the female joints moving away from the male joints is resisted by the mechanical interlocking provided by the engagements of 52 into 53 and 55 into 56. These restraining forces effectively procedure transverse membrane actions into both the exterior and the interior skins resulting in a reduced transverse panel deformation. The prior art systems do not provide this additional restraint. From the forgoing discussions, it is clear that significant improvement on the side joint disengagement strength is achieved by the present invention and Objective No. 1 is accomplished. Upon side joint engagement, the male legs 33 and 36 will be in tight contact with the female groove faces 66 and 67 respectively due to the resilient spring force retained within the male joints and the relative movements between the male and the female joints are restrained due to the mechanical interlocking as explained previously. It becomes apparent that the side joint sealant 38 will be contained within a closed space undisturbed by panel movement due to wind loads. Therefore, long lasting side joint sealing property is ensured and Objective No. 2 is accomplished. The side joint construction reveals that there is no foam core exposed to the air; there is no free air passageway into the foam core; and the mechanically interlocked side joints will reduce the possibility of metal skin joint disengagement in case of fire. Therefore, fire performance will be significantly improved without incurring additional cost or compromising other performance parameters. Objective No. 3 is accomplished.

Figure 5:
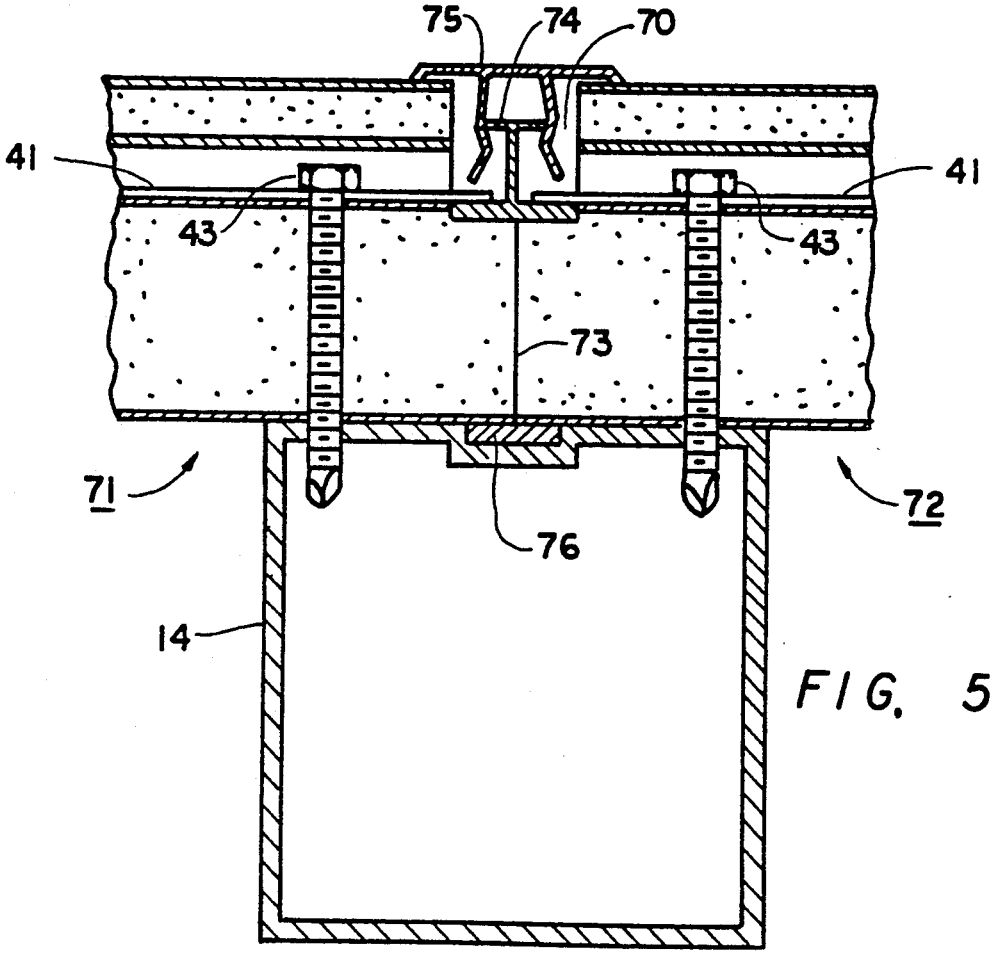
FIG. 5 is a typical fragmentary cross-sectional view taken along line 5—5 of FIG. 1 of the vertical butt joint of this invention.

FIG. 5 is a typical fragmentary cross-sectional view taken along line 5—5 of FIG. 1 of the vertical butt joint in a horizontal application. The end of panel 71 is butted tight against the end of panel 72 over the mullion 14 to form a panel butt joint 73. Before erection, the exterior side of the panel ends are partially notched up to the entire depth containing the exterior metal skin to form a vertical joint cavity 70. Each panel end is fastened into the mullion 14 using a washer plate 41 and a fastener 43. The washer plate 41 is extended partially into the vertical joint cavity 70 to hold the joint cover securing member 74 in position. The joint cover securing member 74 can be a continuous member or intermittent short segments occurring at each four corner intersection point as shown on FIG. 6. The member 74 can be installed with the panel fastening process and in the case of intermittent short segments, they can be installed after the panel erection. The vertical joint cover 75 having a face covering span larger than the width of the vertical joint gap is designed to have spring legs to cause engagement with the top part of the member 74 in a snap in fashion. Members 74 and 75 can be made of extruded aluminum or plastic materials. Vertical joint sealant 76 is provided between the mullion 14 and the interior panel surfaces at butt joint. A depression on the face of the mullion 14 is desirable to maintain a pocket of sealant along the vertical panel butt joint. Marriage sealants (not shown) between the vertical sealant 76 and each horizontal interior side joint sealant 38 (shown on FIG. 4) should be applied in the field. The practical size of the vertical joint cavity 70 in this invention is about ¾ inch (19 mm) wide by 1 inch (25.4 mm) deep. Since only a small amount of foam core is cut away to form the vertical joint, the thermal insulating value at the panel butt joint is largely maintained. The Objective No. 4 is accomplished. The vertical joint cavity 70 is pressure equalized to the exterior air due to the opening at each four corner intersection, therefore, water infiltration into the vertical joint cavity 70 is minimal and most of the water will be intercepted by members 74 and 75 for downward drainage. The possibility for the exterior water to get to the seam line 77 (shown on FIG. 6) of the panel butt joint is very small. Water leakage can only happen if the following three things happen simultaneously: (1) water getting to the seam line 77; (2) water travelling the horizontal distance along the tight butt joint 73 to hit the sealant line 76; and (3) sealant failure along the sealant line 76. Since a pocket of sealant is maintained, sealant failure will not likely to occur with a good field workmanship. The simple panel notching to create the vertical joint cavity 70 can be easily accomplished in the field if necessary. From the above discussions, it is apparent that Objective No. 5 is accomplished.

Figure 6:
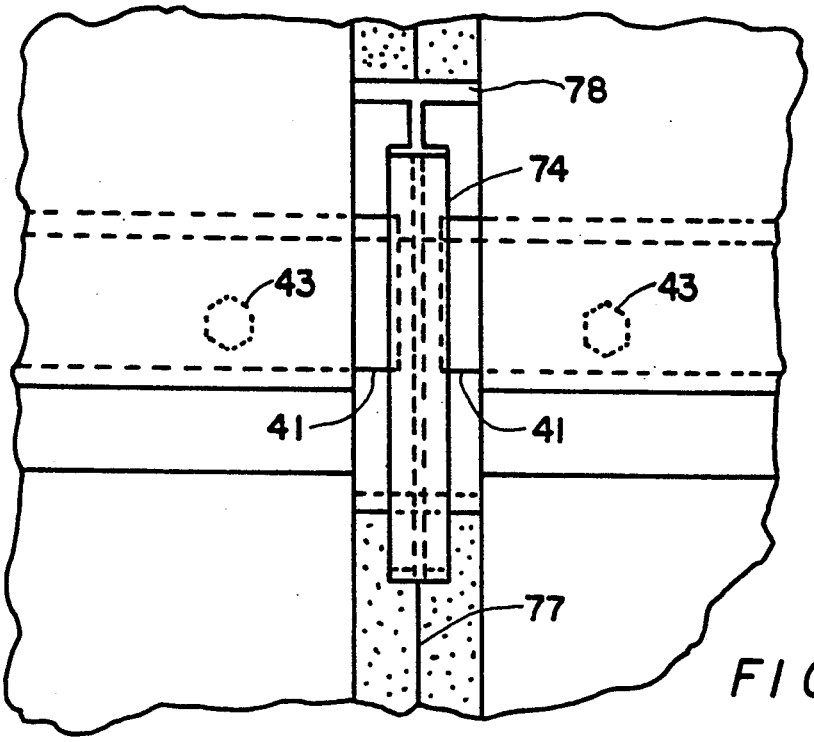
FIG. 6 is a typical fragmentary front view at the panel four corner intersection of FIG. 1 before the application of the vertical joint cover.

FIG. 6 is a typical fragmentary front view at the panel four corner intersection of FIG. 1 before the application of the vertical joint cover 75 in the case of intermittent segments of the joint cover securing member 74. A short segment of member 74 is secured in position by the washer pales 41. The top and the bottom ends of member 74 is preferred to be cut at 45 degrees to provide an outwardly sloping end surface 78. The sloping ends serve to redirect any water getting to member 74 to flow outwardly away from the panel butt seam 77. Similarly, it is desirable to provide an outwardly sloping end surface for member 75 at butt joint.

While I have illustrated and described several embodiments of my invention, it will be understood that these are by way of illustration only and that various changes and modifications may be contemplated in my invention and within the scope of the following claims.

I claim:

1. In a building panel wall assembly formed from individual building panels, each panel having an outer metal facing sheet, an inner metal facing sheet and a structural foam core adhesively connecting said metal sheets, wherein said outer facing sheet and said inner facing sheet have lateral profiled joint-forming surfaces for connecting a pair of said panels in side-by-side relation to a building frame, said outer and inner facing sheets of said panel being reversely bent on one side of said panel and each terminating in an integral reversely bent female joint having a groove with two confronting sheet metal surfaces, said outer and inner facing sheets of said panel being offset inwardly and each terminating in an integral male joint with a protruding male leg on the other side of said panel, which male joints are positioned to interfit with said female joints, a fastener extending through both said outer and inner facing sheets and in the vicinity of said male joints for fastening both of said male joints to a wall panel support, said reversely bent outer facing being extended sufficiently to conceal from view said male and female joints and said fastener, the improvement comprising:

(a). at least one mini-corrugation within one of said confronting sheet metal surfaces of each said female groove;

(b). each said male leg having a reversely bent element with a flared terminating tip;

(c). said flared terminating tip being mechanically interlocked with said mini-corrugation upon panel engagement.

2. The building panel wall assembly of claim 1 together with weather seals contained in said female grooves.

3. The building panel of claim 1 wherein said inner facing sheet at each side of said panel is sloped along a substantially straight plane so as to be in close parallel relationship to an inwardly offset inner facing sheet of the adjoining panel.

* * * * *